US006914568B2

(12) United States Patent
Stoiljkovic et al.

(10) Patent No.: US 6,914,568 B2
(45) **Date of Patent: *Jul. 5, 2005**

(54) INTEGRAL ANTENNA AND RADIO SYSTEM

(75) Inventors: Vladimir Stoiljkovic, Aylesburg (GB); Shanmuganthan Suganthan, Watford (GB); Peter Webster, Bletchley (GB)

(73) Assignee: Centurion Wireless Technologies, Inc., Lincoln, NE (US)

( * ) Notice: Subject to any disclaimer, the term of this patent is extended or adjusted under 35 U.S.C. 154(b) by 71 days.

This patent is subject to a terminal disclaimer.

(21) Appl. No.: 10/625,859

(22) Filed: Jul. 22, 2003

(65) Prior Publication Data

US 2004/0104856 A1 Jun. 3, 2004

Related U.S. Application Data

(63) Continuation-in-part of application No. 09/967,262, filed on Sep. 28, 2001, now Pat. No. 6,618,014.

(51) Int. Cl.[7] ..... H01Q 1/24
(52) U.S. Cl. ..... 343/702; 343/783
(58) Field of Search ..... 343/846, 702, 343/700 MS, 873

(56) References Cited

U.S. PATENT DOCUMENTS 5,903,820 A * 5/1999 Hagstrom ..... 455/82
6,014,113 A * 1/2000 Orchard et al. ..... 343/841
6,031,494 A 2/2000 Okabe et al. ..... 343/702
6,133,886 A 10/2000 Faricello et al. ..... 343/702
6,259,933 B1 7/2001 Bambridge et al. ..... 343/702
6,392,603 B1 * 5/2002 Kurz et al. ..... 343/841
6,618,014 B2 * 9/2003 Stoiljkovic et al. ..... 343/702
2001/0052645 A1 * 12/2001 Op'T Eynde et al. ..... 257/700

* cited by examiner

*Primary Examiner*—Tuyet Vo
*Assistant Examiner*—Ephrem Alemu
(74) *Attorney, Agent, or Firm*—Holland & Hart LLP

(57) ABSTRACT

A Planar Inverted F Antenna (PIFA) and a radio module integrated into a single module. The present invention permits the PIFA to be removably secured on the top of a radio chip module. In one embodiment of the invention, a non-conductive antenna frame is removably secured to a radio chip. A radiating element or "patch" is then secured to the top of the frame. The patch has feed and shorting pins connected thereto. The integrated radio/antenna system can be mounted on a PCB using standard surface-mount techniques and the feed and shorting pins can be soldered to the PCB. In another embodiment of the invention, a cover is removably secured to the frame to retain the patch on the frame. The cover has a window to permit the feed and shorting pins to be soldered to the PCB.

18 Claims, 5 Drawing Sheets

INTEGRAL ANTENNA AND RADIO SYSTEM

RELATED APPLICATIONS

This application is a continuation in part of U.S. patent application Ser. No. 09/967,262, filed Sep. 28, 2001, titled INTEGRAL ANTENNA AND RADIO SYSTEM, now U.S. Pat. No. 6,618,014.

FIELD OF THE INVENTION

The present invention relates to a Planar Inverted F Antenna (PIFA) for wireless communication devices such as wireless modems, cellular telephones, personal digital assistants, etc. More particularly, the present invention relates to a radio module and an antenna combined into a single unit.

DESCRIPTION OF THE RELATED ART

With the rapid progress in wireless communication technology and the ever-increasing emphasis for its expansion, wireless modems on laptop computers and other handheld radio devices will be a common feature. Recently, in the cellular communication industry, there has been an increasing emphasis on internal antennas instead of conventional external wire antennas. The concept of an internal antenna stems from the avoidance of a protruding external radiating element by the integration of the antenna into the device itself. Internal antennas have several advantageous features such as being less prone to external damage, a reduction in overall size of the handset, and easy portability. Among the various choices for internal antennas, a PIFA appears to have great promise. The PIFA is characterized by many distinguishing properties such as relative light weight, ease of adaptation and integration into the device chassis, moderate range of bandwidth, Omni-directional radiation patterns in orthogonal principal planes for vertical polarization, versatility for optimization, and multiple potential approaches for size reduction. The PIFA also finds useful applications in diversity schemes. Its sensitivity to both vertical and horizontal polarization is of immense practical importance in mobile cellular/RF data communication applications because of absence of the fixed antenna orientation as well as the multi-path propagation conditions. All these features render the PIFA to be a good choice as an internal antenna for mobile cellular/RF data communication applications.

One of the most difficult manufacturing and production issues for internal antennas is finding a method for combining the radio module and the antenna in a single unit. One method of combining a radio module and an antenna is by integrating the antenna within a radio module using the same manufacturing processes ["The Race for Bluetooth Integration Steams Ahead", *Wireless Systems Design*, October 2000]. A ceramic chip antenna is bonded to the radio chip pads using special assembly techniques. These special assembly techniques make the integral unit expensive and, because the radio chip is small, the antenna performance is not optimal. Furthermore, the radio system designer has no flexibility of tuning the antenna to a particular application and using different radio-chip/antenna combinations because the design of the antenna and the chip is fixed.

SUMMARY OF THE INVENTION

A method of integrating a PIFA and a radio module into a single unit is disclosed. The present invention permits the PIFA to be removably secured on the top of a radio module. In one embodiment of the invention, a dielectric antenna carrier is removably mounted on and secured to the radio module. A radiating element or "patch" is then secured to the top of the frame. The patch has feed and shorting pins connected thereto and extending therefrom. The integrated radio/antenna system can be mounted on a PCB using standard surface-mount techniques with the feed and shorting pins soldered to the PCB. In another embodiment of the invention, a cover is removably secured to the carrier to retain the patch on the carrier. The cover has a window formed therein to permit the feed and shorting pins to be soldered to the PCB.

It is therefore a principal object of the invention to provide a single integrated radio/antenna system to reduce the amount of space required on a PCB.

A further object of the invention is to provide a radio/antenna system to reduce the amount of assembly handling and inventory levels in making final wireless communication devices.

Yet another object of the invention is to provide a patch that can be surface-mounted to the PCB.

A further object of the invention is to provide a flexible design of the radio/antenna system to facilitate different radio/antenna combinations.

Still another object of the invention is to provide an integral radio/antenna system that is simply configured, compact, cost-effective to manufacture, and easy to fabricate.

These and other objects will be apparent to those skilled in the art.

DETAILED DESCRIPTION

Figure 1:
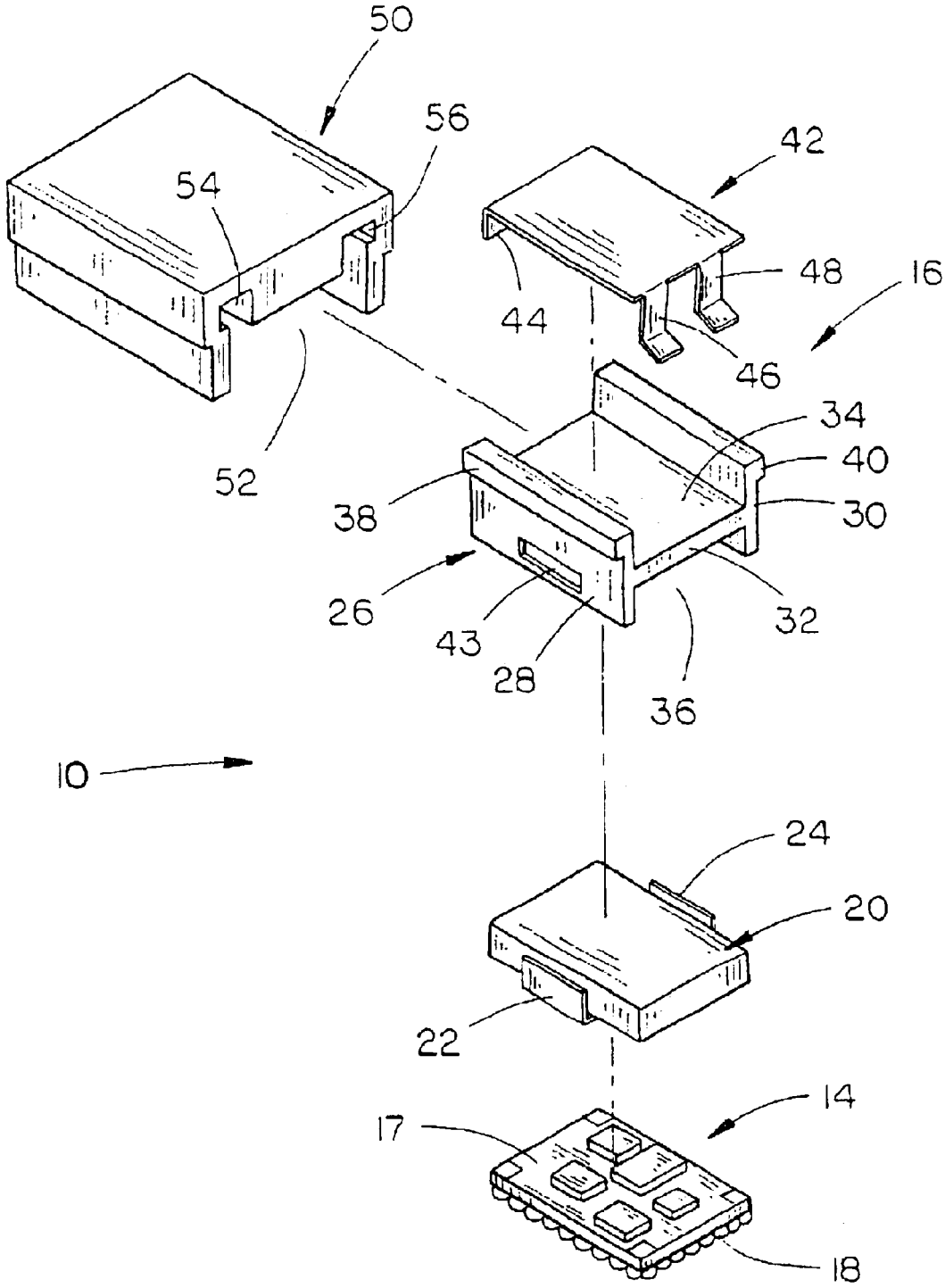
FIG. 1 is an exploded perspective view illustrating an integral antenna and radio unit mounted.

The numeral 10 refers to the first embodiment of an integral antenna and radio unit (FIGS. 1–3) of this invention which is ideally suited for use in wireless communication devices such as wireless modems, cellular telephones, personal digital assistants, etc. The wireless communication device includes a printed circuit board (PCB) 12 onto which the unit 10 is mounted. Unit 10 generally includes a radio module 14 and a PIFA module 16. Radio module 14 includes a chip 17 that is provided with a connector 18, such as ball array pads or the like attached in a conventional fashion. Radio module 14 also includes a shielding cover 20 having a pair of folding tabs 22 and 24 at opposite sides thereof.

Module 16 includes a carrier 26. The carrier 26 comprises a non-conductive element that prevents direct Radio Frequency conduction between the radio module 14 and the PIFA module 16. The carrier 26, for example, may comprise a suitable dielectric or insulating material, such as a high temperature dielectric material. While stray electromagnetic fields may create an indirect RF connection between radio module 14 and the PIFA module 16, the carrier 26 prevents a direct RF link between the radio module 14 and the PIFA module 16.

Carrier 26 is generally H-shaped and includes sides 28 and 30 having a web 32 extending therebetween which defines an upper recessed area 34 and a lower recessed area 36. The upper outer ends of sides 28 and 30 have ribs or shoulders 38 and 40 extending outwardly therefrom, respectively. The lower ends of sides 28 and 30 are each provided with a slot or opening 43 formed therein which are adapted to receive the tabs 22 and 24 therein, as will be described hereinafter.

The radiating patch 42 of PIFA module 16 is mounted on the upper surface of web 32 and is secured thereto by gluing, etc. Radiating patch 42 of PIFA module 16 may have a folded-over portion 44 extending from one end thereof in a perpendicular fashion to patch 42. A feed contact or pin 46 and a shorting contact or pin 48 extend downwardly from one end of the patch 42 for contact with the PCB 12. PIFA module 16 includes a cover 50 having a recessed portion 52 formed in its lower end, as seen in FIG. 1. Cover 50 includes slots 54 and 56 formed therein which are adapted to slidably receive the shoulders or ribs 38 and 40, respectively, to maintain cover 50 on the carrier 26.

As stated, the carrier 26 comprise a non-conductive element and is attached to the shielding cover 20 of radio module 14. The radio module 14 is positioned in the lower recessed area 36 of the carrier 26 with the carrier 26 being secured to the cover 20 by means of the folding tabs 22 and 24 extending through the openings 43 in the sides 28 and 30 of carrier 26, respectively. The carrier 26 could also be secured to the cover 20 by gluing, or by other methods of tabs. The patch 42 is then placed on the upper surface of the web 32 of carrier 26 and retained thereon by sliding the cover 50 over the carrier 26 so that the slots 54 and 56 receive the ribs or shoulders 38 and 40, respectively. Patch 42 could also be secured to the carrier by gluing or the like.

The integral unit 10 may be surface-mounted onto the PCB 12. The radio module 14 is supplied with connector 18, such as the ball grid array pads, on the radio module chip 17. The contacts 46 and 48 are soldered to the PCB 12.

Figure 3:
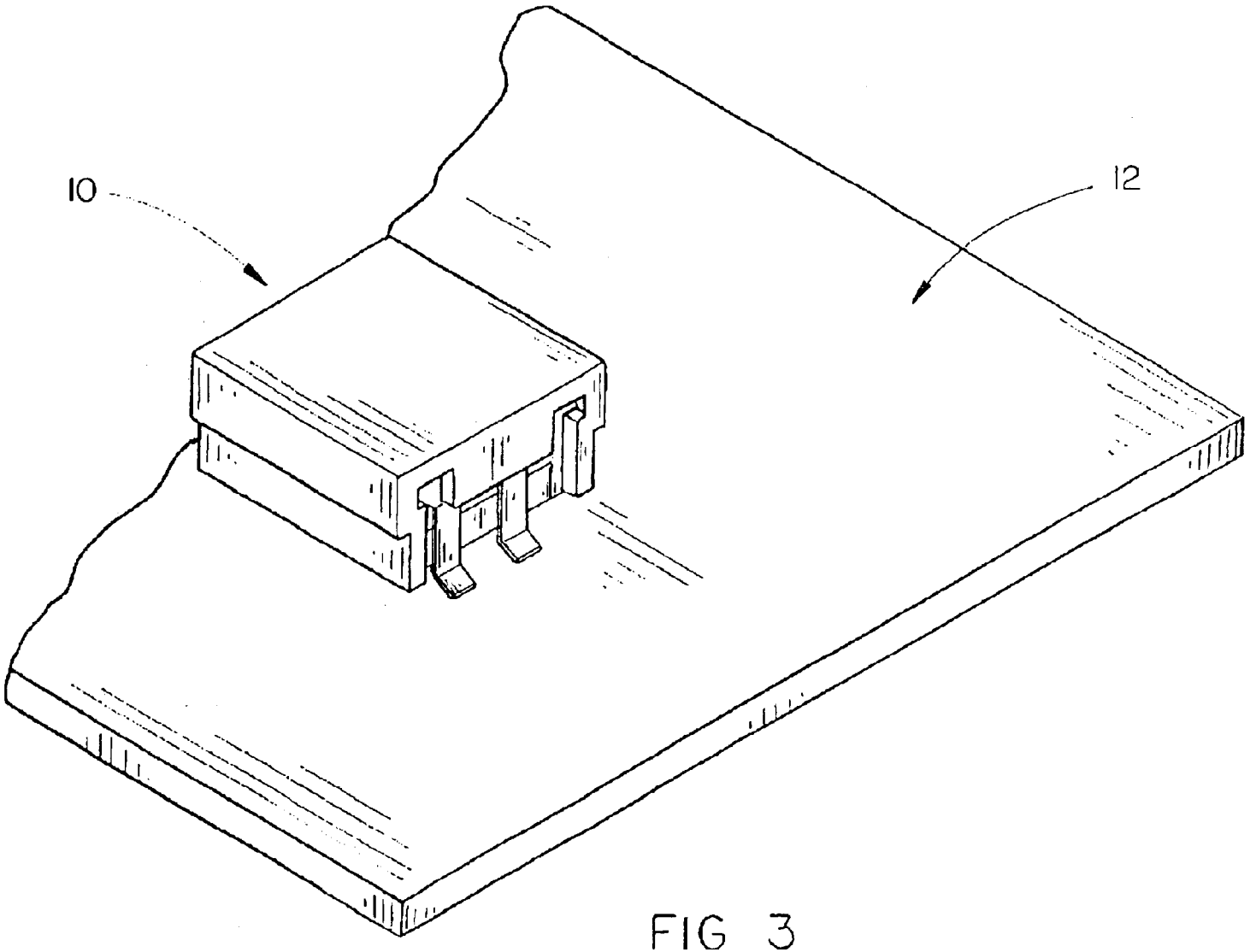
FIG. 3 is a perspective view of the radio/antenna unit of FIGS. 1 and 2 mounted on a PCB.
Figure 5:
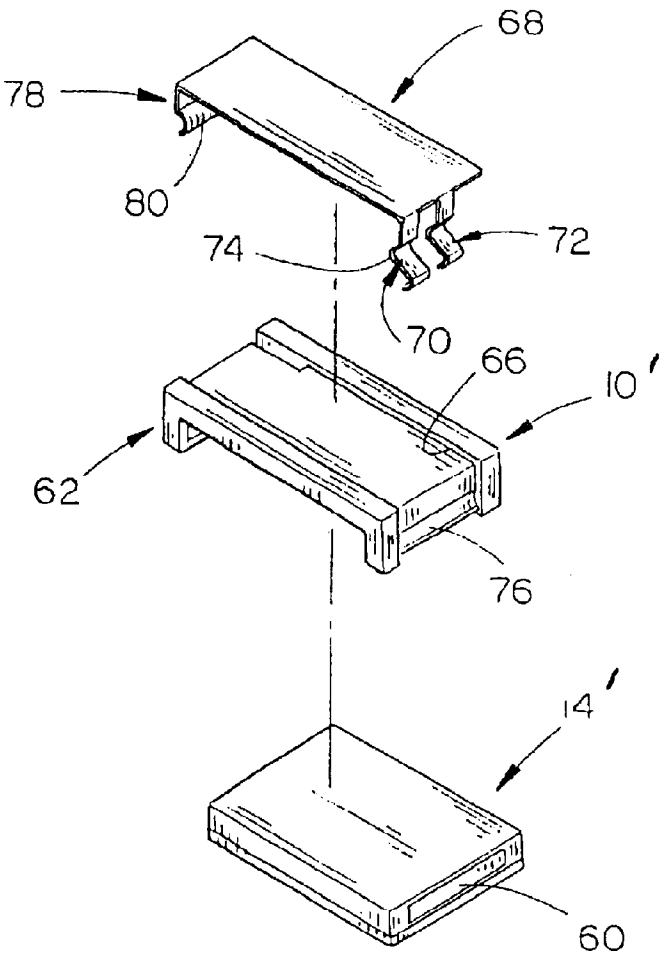
FIG. 5 is an exploded perspective view of the radio/antenna system of FIG. 4.
Figure 4:
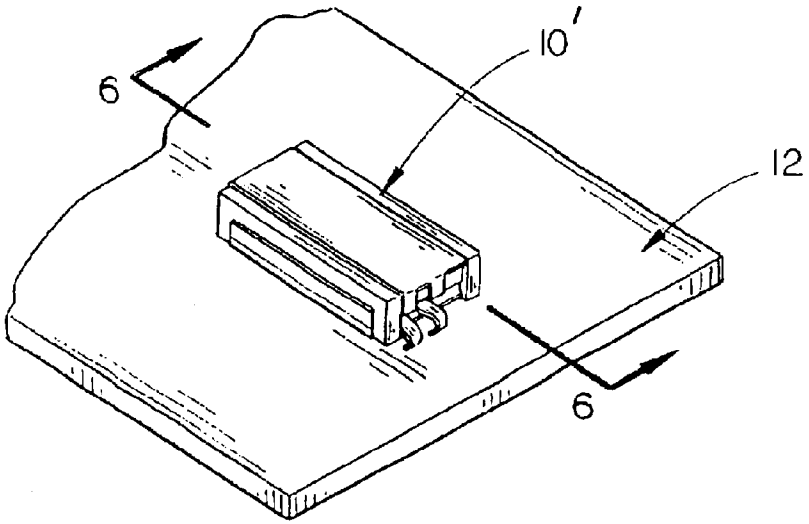
FIG. 4 is a perspective view of a second embodiment of the radio/antenna system.
Figure 6:
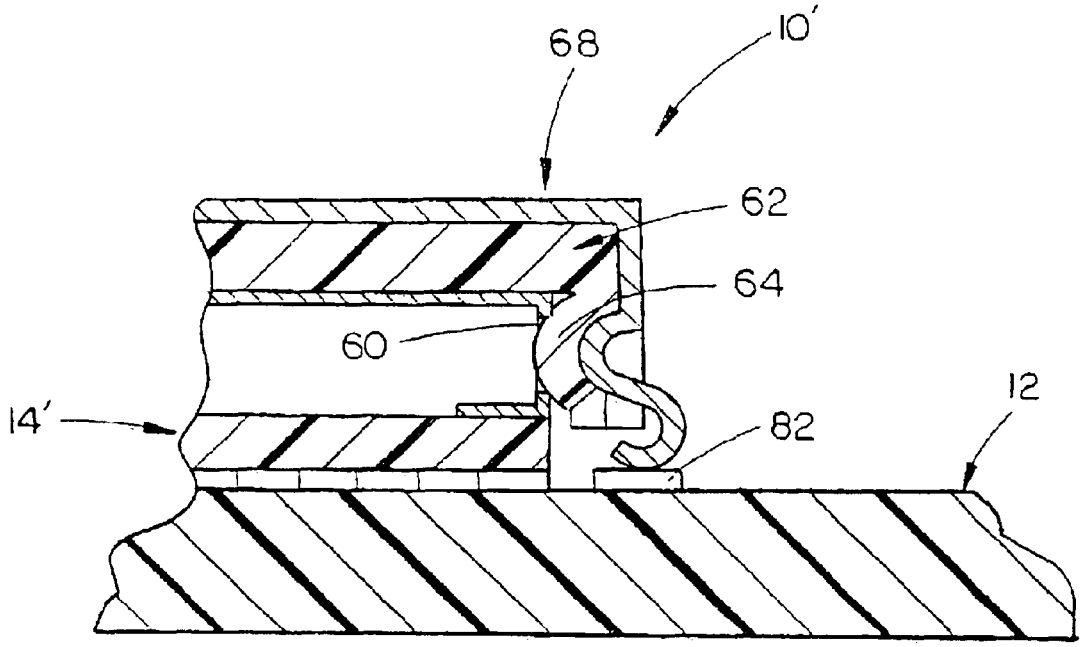
FIG. 6 is a sectional view taken along lines 6—6 in FIG. 4.

In FIGS. 4–6, a modified form of the integral antenna and radio unit is illustrated and which is referred generally by the reference numeral 10'. The integral antenna and radio unit 10' is adapted to be mounted on the PCB 12, as previously discussed. The radio module 14' is generally similar to radio module 14, as seen in FIGS. 1–3, except that the module 14' has a cut-out or indention 60 formed therein at each end thereof.

The numeral 62 refers to a non-conductive carrier. Carrier 62 is provided with inwardly protruding arcuate portions 64 at each of its ends which are received in the cut-outs 60 at each end of the module 14' to secure the carrier 62 to the module 14'. As seen in FIG. 5, carrier 62 is provided with a recessed portion 66 formed therein which gives the carrier 62 some flexibility so that the arcuate portion 64 will adequately seat in the cut-out areas 60.

The numeral 68 refers to a patch which clips over the carrier 62 and includes a ground contact 70 and a feed contact 72. Each of the contacts 70 and 72 are provided with an inwardly extending arcuate portion 74 which are adapted to be received in the recessed area or indentation 76 formed in carrier 62. As seen in FIG. 5, patch 68 has a downwardly extending portion 78 which has an inwardly extending or protruding arcuate portion 80 which is adapted to be received in an indentation formed in the end of carrier 62 opposite to that of indentation 76. Thus, the patch 78 snaps into place on the carrier. By using appropriate spring-like materials and shapes, as shown, it is possible to provide a means of clipping both the carrier 62 and the patch 68 onto the radio module 14'.

Figure 2:
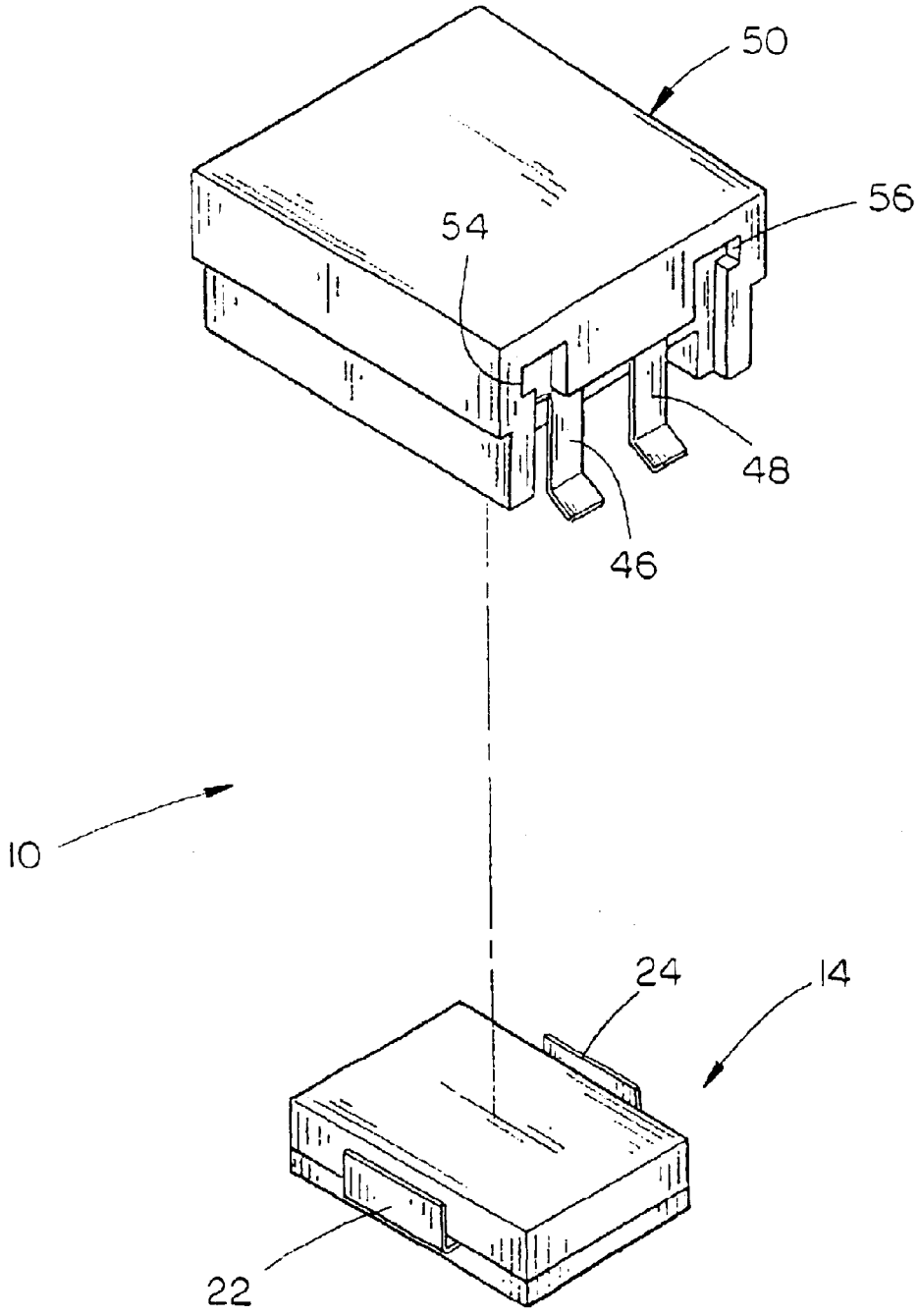
FIG. 2 is a partially exploded perspective view illustrating the radio module and the antenna carrier assembly of FIG. 1.

The integral antenna and radio unit 10' is mounted on the PCB 12 in the same fashion as that described in the embodiment of FIGS. 1–3. The contacts 70 and 72 are soldered to appropriate pads on the PCB 12 such as indicated by the reference numeral 82 in FIG. 6.

Thus it can be seen that a unique integral antenna and radio unit has been provided which accomplishes at least all of its stated objectives.

We claim:

1. An integral antenna and radio unit for a wireless communication device including a printed circuit board (POB), comprising:

a radio module comprising a first RF connection to a PCB, the radio module being secured to the PCB;

wherein said radio module comprises a radio chip and a shielding cover extending over said radio chip; and an antenna module comprising a second RF connection to the PCB, said antenna module being removably secured to said radio module;

wherein said antenna module comprises a non-conductive carrier having an upper end and a lower end said lower end of said carrier having a recesses area formed therein which receives said radio module therein, and an antenna positioned on said upper end of said carrier having contact pins extending therefrom forming the second RF connection to the PCB, wherein said radio module and said antenna module are not directly RF connected.

2. The integral antenna and radio unit of claim 1 further comprising a cover that extends over said antenna module.

3. The integral antenna and radio unit of claim 1 wherein said upper end of said carrier has a recessed area formed therein and wherein said antenna module is received in said recessed area in said upper end of said carrier.

4. The integral antenna and radio unit of claim 1 wherein said antenna comprises a PIFA.

5. The integral antenna and radio unit of claim 1, wherein said second RF connection is formed by at least one contact pin.

6. The integral antenna and radio unit of claim 1, wherein said second RF connection is formed by at least a feed contact and a shorting contact.

7. The integral antenna and radio unit of claim 1, wherein said first RF connection is formed by at least one ball array pad.

8. The integral antenna and radio unit of claim 1 wherein said cover is releasably to said carrier.

9. The integral antenna and radio unit of claim 8 wherein said cover is slidably mounted on said carrier.

10. The integral antenna and radio unit of claim 1 wherein said antenna module is snapped onto said carrier.

11. The integral antenna and radio unit of claim 10 wherein said carrier is snapped onto said radio module.

12. The integral antenna and radio unit of claim 1, further comprising a non-conductive carrier separating said radio module and said antenna module.

13. The integral antenna and radio unit of claim 12, wherein said carrier comprises a dielectric material.

14. The integral antenna and radio unit of claim 12, wherein said carrier comprises an insulating material.

15. An integral antenna and radio unit for a wireless communication device including a printed circuit board (PCB), comprising:

a radio module comprising a first RE connection to a PCB, said radio module being secured to the PCB;

wherein said radio module comprises a radio chip and a shielding cover extending over said radio chip;

an antenna module comprising a second RE connection to a PCB, said antenna module being removably secured to said radio module;

wherein said antenna module comprises a non-conductive carrier having an upper end and a lower end, said lower end of said carrier having a recesses area formed therein which receives said radio module therein, and an antenna positioned on said upper end of said carrier having contact pins extending therefrom forming the second RF connection to the PCB, and means for prohibiting a direct RF connection between said radio module and said antenna module.

16. The integral antenna and radio unit of claim 15, wherein the means for prohibiting comprises at least an RF insulating material.

17. The integral antenna and radio unit of claim 15, wherein the means for prohibiting comprises at least an RF dielectric material.

18. The integral antenna and radio unit of claim 15, wherein said antenna module comprises a carrier; the carrier forming the means for prohibiting.

* * * * *